US007159947B1

(12) United States Patent
Lee

(10) Patent No.: US 7,159,947 B1
(45) Date of Patent: Jan. 9, 2007

(54) ADJUSTMENT MECHANISM FOR ARMREST

(76) Inventor: Hwang-Pao Lee, No. 807, Po-Ai Street, Cu-Pei City 302, Hsin-Chu County (TW)

( * ) Notice: Subject to any disclaimer, the term of this patent is extended or adjusted under 35 U.S.C. 154(b) by 0 days.

(21) Appl. No.: 11/480,921

(22) Filed: Jul. 6, 2006

(30) Foreign Application Priority Data

Apr. 27, 2006 (TW) ..... 95207163 U

(51) Int. Cl.
*A47C 7/54* (2006.01)

(52) U.S. Cl. ..... 297/411.37; 297/411.35

(58) Field of Classification Search ..... 297/411.35, 297/411.37

See application file for complete search history.

(56) References Cited

U.S. PATENT DOCUMENTS 5,484,187 A * 1/1996 Doerner et al. ..... 297/411.3
5,641,203 A * 6/1997 Van De Riet et al. .. 297/411.37
6,017,091 A * 1/2000 Cao ..... 297/411.37
6,460,932 B1 * 10/2002 Kopish et al. ..... 297/411.36
6,502,904 B1 * 1/2003 Hansen ..... 297/411.35
6,540,300 B1 * 4/2003 Piretti ..... 297/411.35
6,948,775 B1 * 9/2005 Tsai ..... 297/411.37

* cited by examiner

*Primary Examiner*—Peter R. Brown
(74) *Attorney, Agent, or Firm*—Troxell Law Office, PLLC

(57) ABSTRACT

An adjustment mechanism for armrests includes an armrest plane and a lower plate fastened under the armrest plane. A removable block with smaller length is disposed inside the lower plate. Elastic locating rings are disposed on right and left sides of the removable lock, corresponding to linear locating slot composed of a plurality of curved slots on right and left sides of an inner part of the lower plate. Thus the removable block and the lower plate are moving or located relative to each other. A rectangular slot with a rectangular piece whose width is smaller than that of the rectangular slot is mounted on the removable block. And curved slots for location is arranged on side of the rectangular piece so that the rectangular piece and the rectangular slot move transversely and being located, relative to each other. Moreover, a round slot with a disc therein is arranged on the rectangular piece while a plurality of locating slots is mounted on circumference of the disc so that the rectangular piece and the disc rotate and locate relative to each other. By a fastening member inserting through the disc, the rectangular piece, and the transverse slot on bottom of the removable block, the disc is secured on a fastening seat that is secured on the armrest support. Thereby the armrest has adjustable rotation angle, longitudinal displacement and transverse displacement, relative to the armrest support.

6 Claims, 6 Drawing Sheets

ADJUSTMENT MECHANISM FOR ARMREST

BACKGROUND OF THE INVENTION

The present invention relates to an adjustment mechanism for armrests, especially to an armrest with adjustable width and rotation angles.

Generally, common seat armrests consist of two parts-armrests and supports. The armrests are disposed on top of the supports while the supports are secured firmly on right and left sides of seats by screws or other means. Traditional office chairs often have several adjustments: armrest height and level adjustment. The level adjustment mechanism for adjusting horizontal position or angles generally is arranged on the armrests. Although there are various adjustment mechanisms available now, an adjustment mechanism with simple structure and multiple functions of adjusting horizontal positions or angle is rare. The present invention provides such kind of design.

SUMMARY OF THE INVENTION

Therefore it is a primary object of the present invention to provide an adjustment mechanism for armrests that includes a removable block with shorter width disposed under a lower plate of the armrest. The removable block moves forwards and backwards, relative to the lower plate. A rectangular slot with a rectangular piece whose width is smaller than that of the rectangular slot is mounted on the removable block. The rectangular piece and the rectangular slot move transversely, relative to each other. Moreover, a round slot with a disc therein is arranged on the rectangular piece. The rectangular piece and the disc move relative to each other. The center of the disc is secured on a base that is fastened on an armrest support. Thereby the armrest has adjustable rotation angle, longitudinal displacement and transverse displacement.

It is another object of the present invention to provide an adjustment mechanism for armrests that includes a locating ring or a locating pin elastically assembling with a curved slot, disposed between the removable block and the lower plate, between the rectangular piece and the removable block, or between the disc and the rectangular piece so as to make the armrest have adjustable rotation angle, longitudinal displacement and transverse displacement.

DETAILED DESCRIPTION OF THE PREFFERED EMBODIMENT

Figure 1:
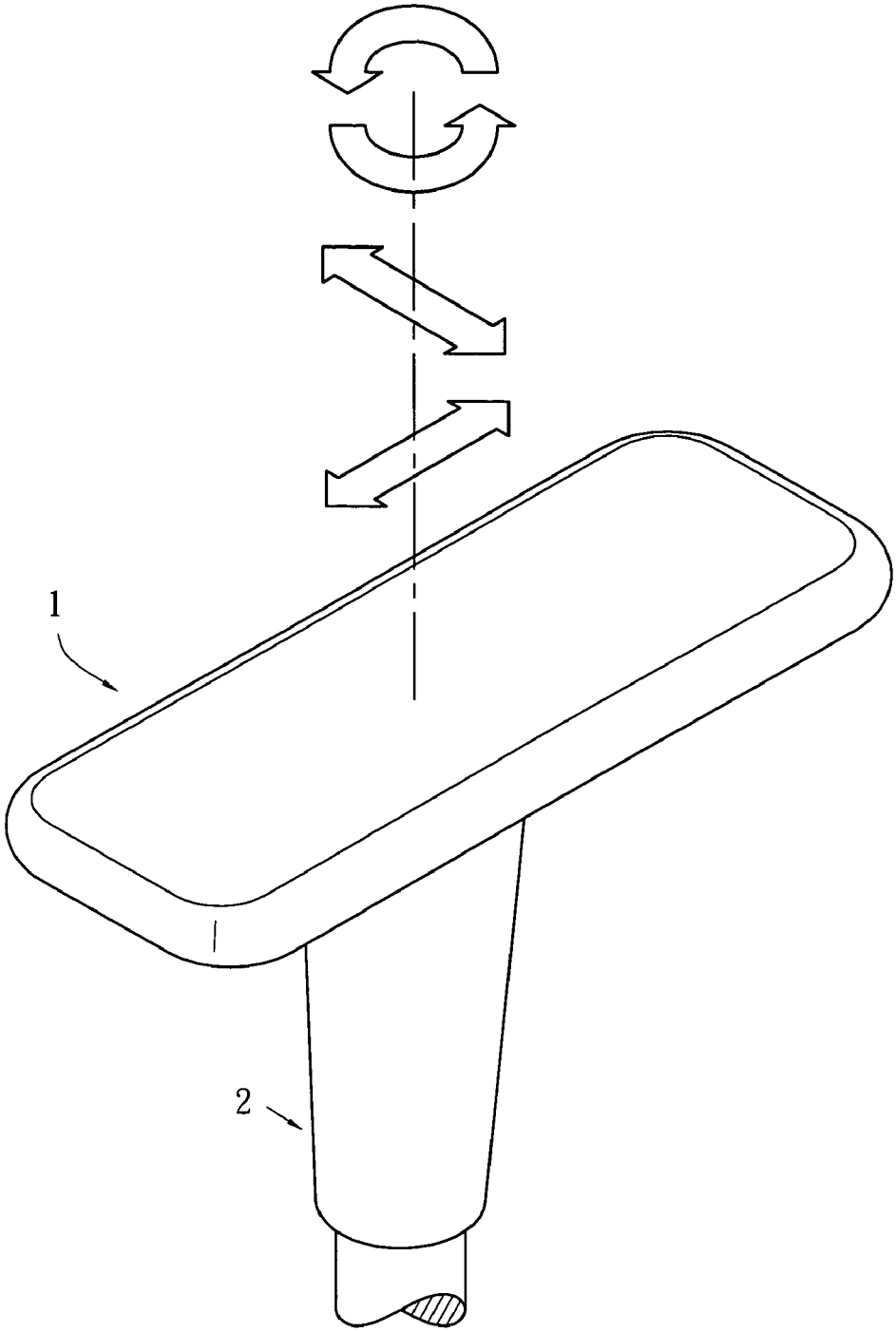
FIG. 1 is a perspective view of an embodiment in accordance with the present invention.
Figures 2, 2A:
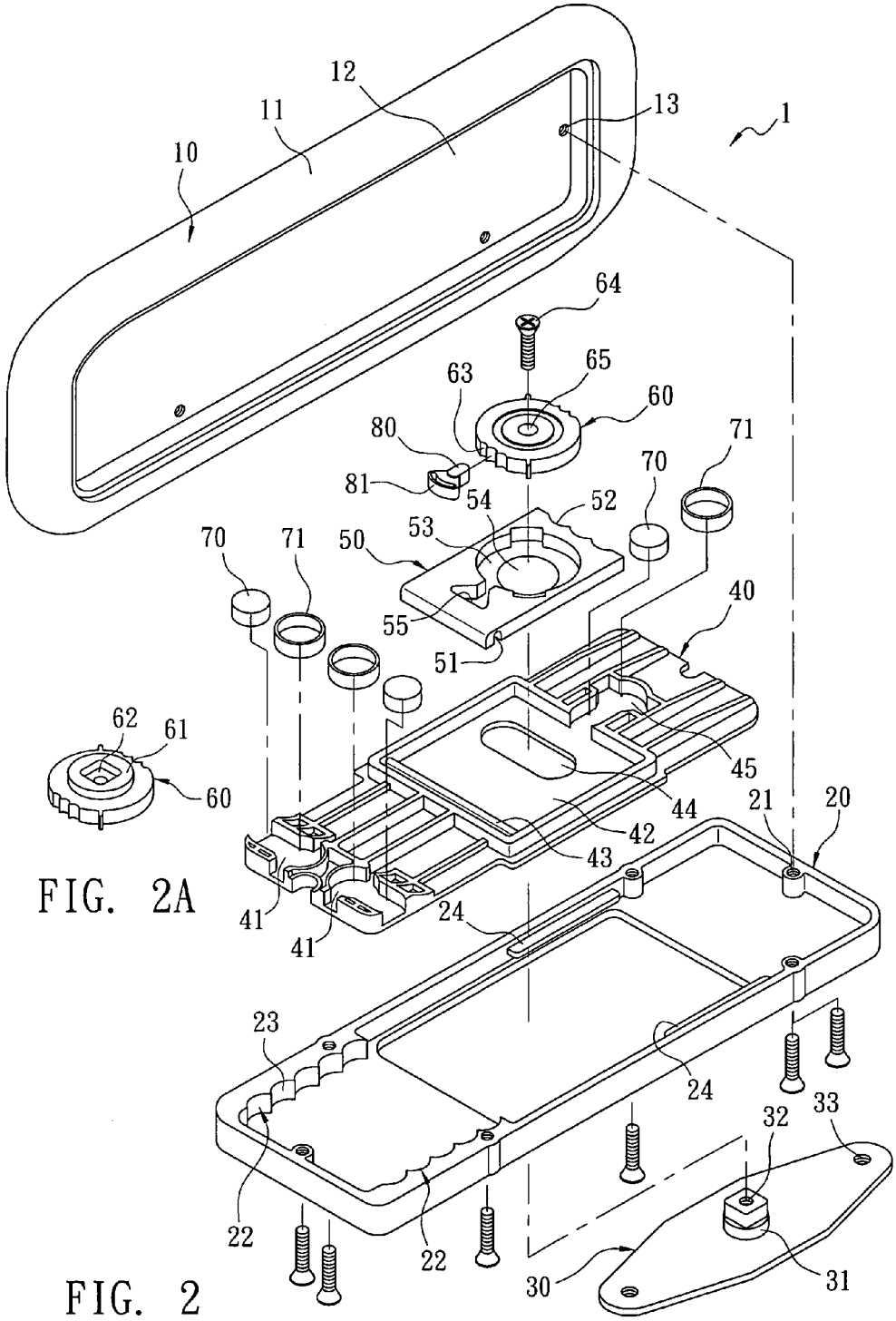
FIG. 2 is an explosive view of an embodiment in accordance with the present invention.
FIG. 2A is a bottom view of a disc of an embodiment in accordance with the present invention.
Figure 3:
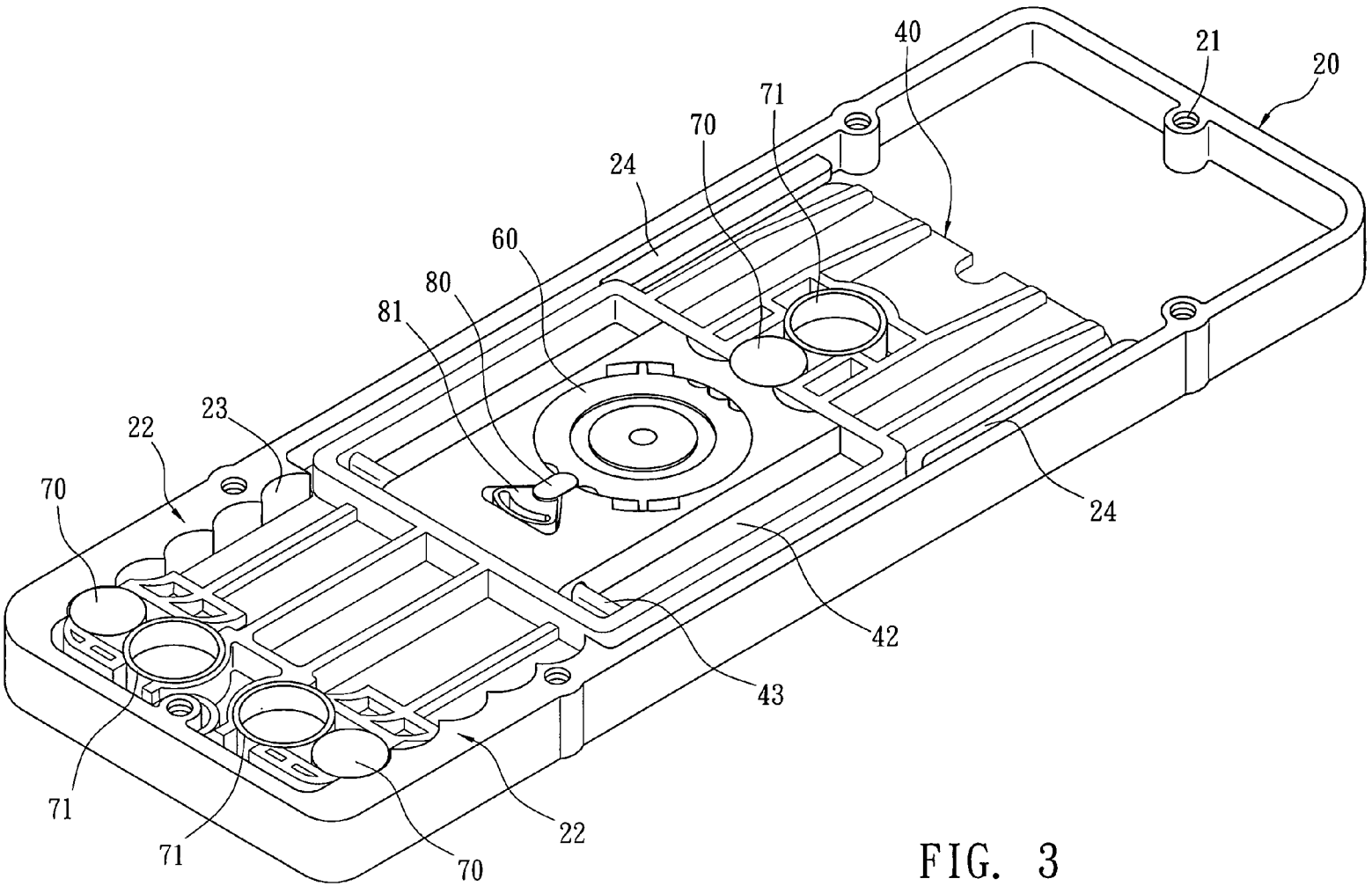
FIG. 3 is a schematic drawing of partial assembly of the embodiment in FIG. 2 according to the present invention.

Refer from FIG. 1 to FIG. 3, an armrest 1 of the present invention secured on top surface of an armrest support 2 consists of an armrest plane 10, a lower plate 20, a base 30, a removable block 40, a rectangular piece 50, a disc 60, a locating ring 70 as well as corresponding elastic member 71, a locating pin 80 and corresponding elastic member 81. The armrest plane 10 is composed by a soft pad layer 11 integrated with a hard plate layer 12. The soft pad layer 11 is made from plastic, rubber, or sponge for providing users good feelings of touch while the hard plate layer 12 is formed by iron or plastic and having a plurality of tapped holes 13 for being assembled with corresponding tapped holes 21 on the lower plate 20. The lower plate 20 is a plastic housing, screwed with the hard plate layer 12 so as to form a rectangular space 25 between the armrest plane 10 and the lower plate 20 for accommodation of adjustment members.

Two linear locating slots 22 having a plurality of identical curved slots 23 are symmetrically mounted on right and left sides of inner part (front or rear) of the lower plate 20. On the other end, a strip-type flange 24 is disposed on both right and left sides of the lower plate 20 symmetrically and a sliding slot is formed under the flange 24.

The removable block 40 is mounted inside the lower plate 20 and its edges slides inside the sliding slot under the flange 24. The length of the removable block 40 is shorter than the length of inner part of the lower plate 20. Two symmetrical slots 41 are arranged on right and left sides of one end of the removable block 40 for accommodating a locating ring 70 as well as an elastic member 71 that presses the locating ring 70. The slots 41 correspond to the locating slots 22 of the lower plate 20 so that the removable block 40 is located inside the lower plate 20 by the locating ring 70 elastically mounting into one of the curved slots 23 of the locating slots 22. Moreover, a rectangular slot 42 is set near middle part of the removable block 40. A transverse guiding rail 43 is arranged on an inner side of the rectangular slot 42 and a transverse slot 44 is disposed near the middle part of the rectangular slot 42. A slot 45 is set on one side of the rectangular slot 42 for accommodating the locating ring 70 as well as the elastic member 71 that presses the locating ring 70 so that the locating ring 70 can push elastically toward inner part of the rectangular slot 42.

The rectangular piece 50 is mounted inside the rectangular slot 42. A slot 51 on bottom of the rectangular piece 50 corresponds to and assembles with the guiding rail 43. The width of the rectangular piece 50 is smaller than the width of inner part of the rectangular slot 42. A plurality of curved slot 52, corresponding to the slot 45 of the removable block 40, is arranged linearly on one side of the rectangular piece 50. Thus the rectangular piece 50 is located inside the rectangular slot 42 by the locating ring 70 inside the slot 45 elastically matches a curved slot 52 while sliding transversely therein. A round slot 53 with a central hole 54 on the bottom thereof is disposed on the rectangular piece 50. A slot 55 is disposed on circumference of the round slot 53 for accommodating a locating pin 80 and an elastic member 81 that presses the locating pin 80 so that the locating pin 80 elastically presses inner part of the round slot 53. The above-mentioned elastic members 71, 81 are rubber rings with elasticity and are able to presses the locating ring 70, and the locating pin 80 to project outwards.

Figure 4:
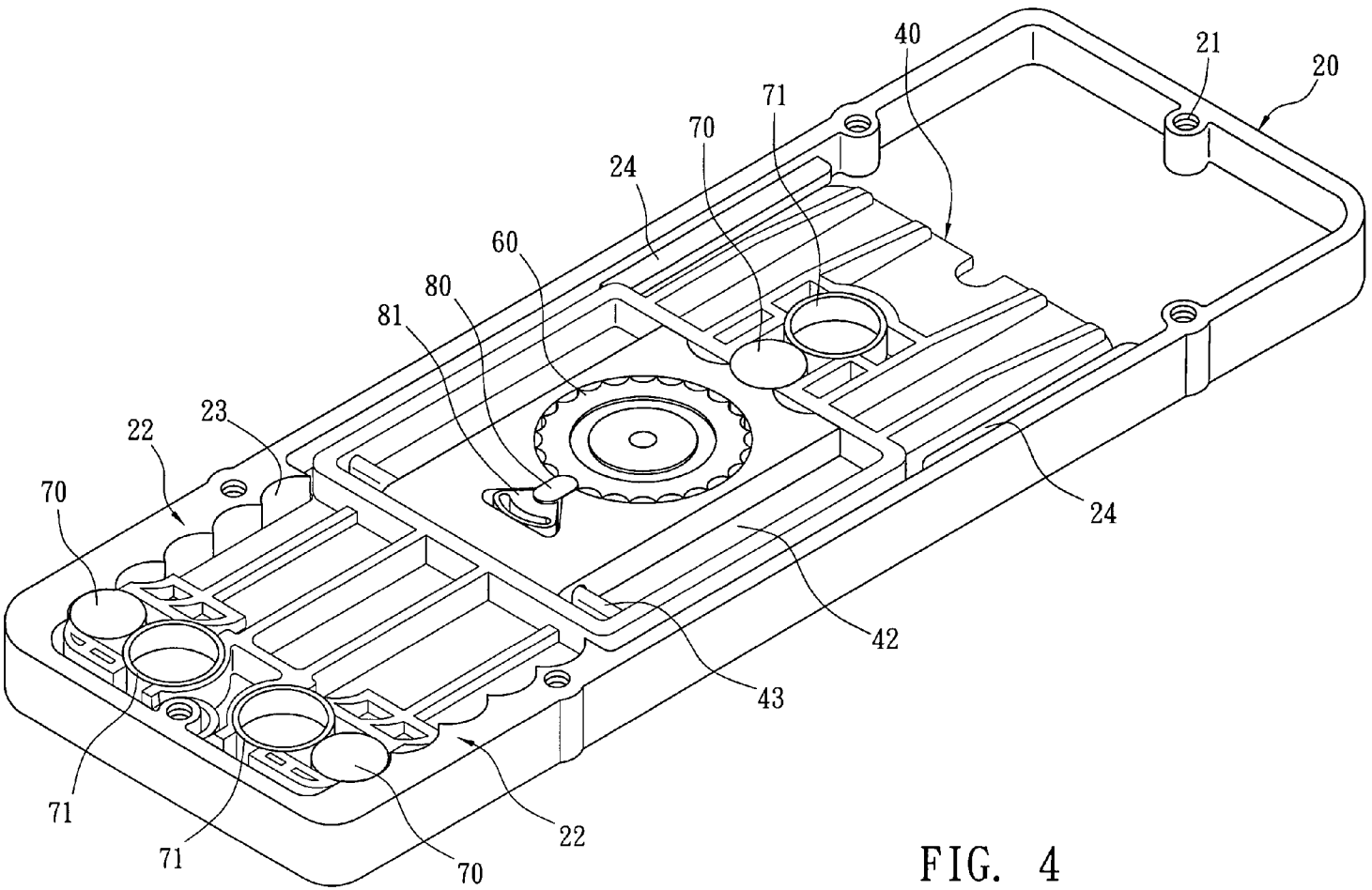
FIG. 4 is a schematic drawing of partial assembly of another embodiment in accordance with the present invention.

The disc 60 is assembled inside the round slot 53 of the rectangular piece 50. As shown in FIG. 2A, a step-like collar 61 is formed on bottom of the disc 60, corresponding to the central hole 54 on bottom of the round slot 53. A rectangular hole 62 is arranged on bottom of the collar 61, corresponding to and secured with a fastening seat 31 on the base 30. A plurality of locating slots 63 corresponding to the slot 55 of the rectangular piece 50 is disposed on circumference of the disc 60. When the disc 60 is rotated inside the round slot 53, it is located by the locating pin 80 elastically matching with the locating slot 63 inside the slot 55. As shown in FIG. 2 & FIG. 3, the locating slots 63 are arranged on circumference of the disc 60 in certain central angle so that the rotation angle is restricted inside certain range of the central angle. Moreover, the locating slots 63 can also be disposed on whole circumference of the disc 60, as shown in FIG. 4, and the rotation angle is 360 degrees. Furthermore, by a fastening member 64 such as screws inserting through a central hole 65, the rectangular piece 50, the transverse slot 44 on bottom of the removable block 40, the disc 60 is secured on a fastening hole 32 of the fastening seat 31 of the base 30. The base 30 attaches on the bottom of the lower plate 20. A lock hole 33 is respectively arranged on two sides of the base 30 for fastening the base 30 with the armrest support 2 (as shown in FIG. 1). Thus it is learned that the armrest plane 10 is fastened with the lower plate 20 to form an armrest 1 while the disc 60, the base 30 and the armrest support 2 are integrated with one another so that the disc 60 and the base 30 keep immobile, relative to the armrest support 2. In usage, the lower plate slides forwards and backwards, relative to the removable block 40 and is located by the locating ring 70 elastically matching one of the curved slots 23 on the locating slot 22. Thus the armrest 1 is able to be adjusted forwards or backwards, as a longitudinal arrow indicates in FIG. 1. Moreover, the removable block 40 is able to move transversely, relative to the rectangular piece 50 and is located by the locating ring 70 elastically assembling with one of the curved slots 52. Thus the armrest 1 is able to be adjusted transversely, as a transverse arrow indicates in FIG. 1. Furthermore, the rectangular piece 50 rotates in a certain angle relative to the disc 60 and is located by the locating pin 80 inside the slot 55 elastically matching one of the locating slots 63 so that rotation angle of the armrest 1 is adjusted, as shown in an arrow in FIG. 1.

Figure 5:
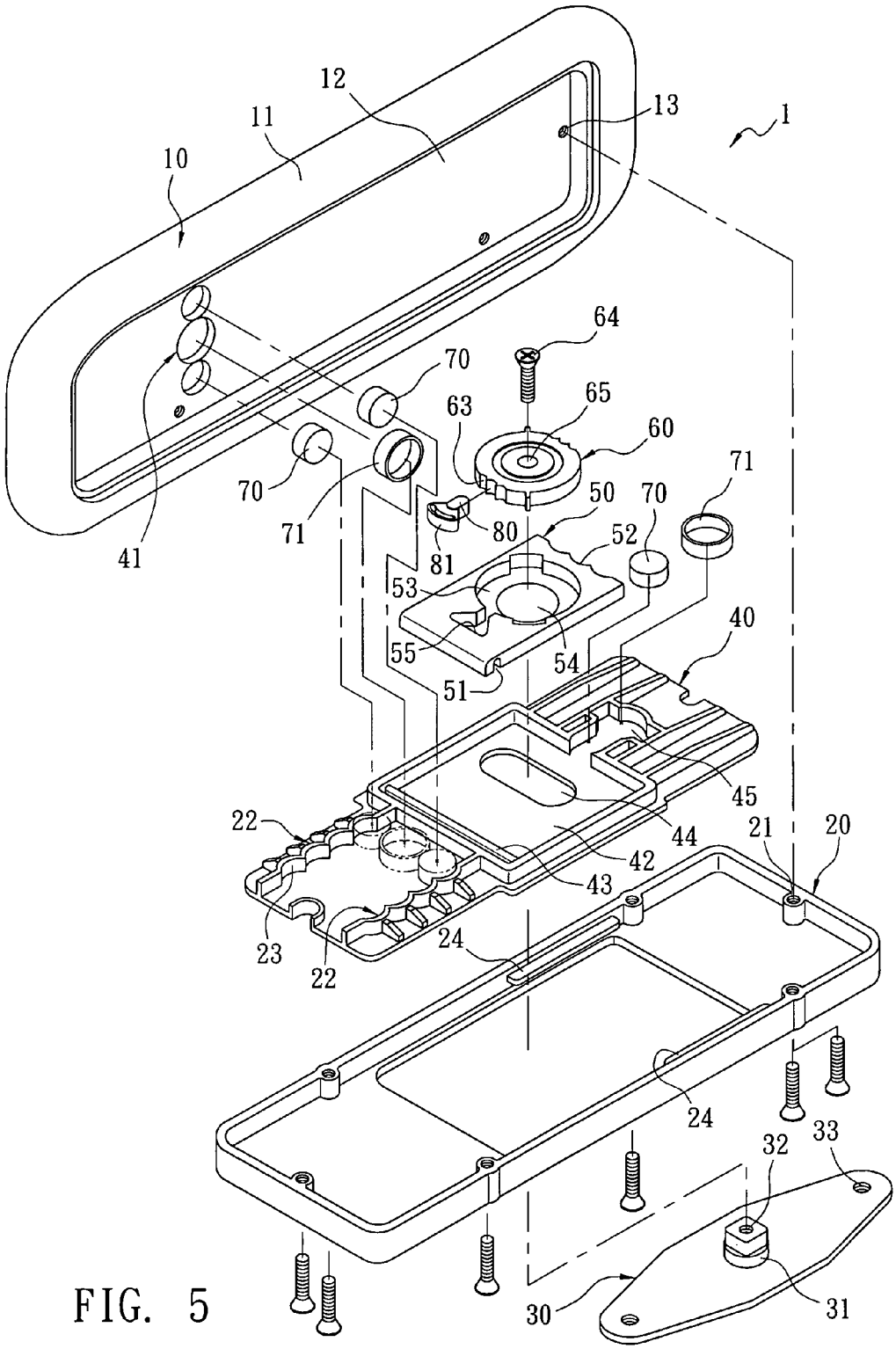
FIG. 5 is an explosive view of another embodiment in accordance with the present invention.
Figure 6:
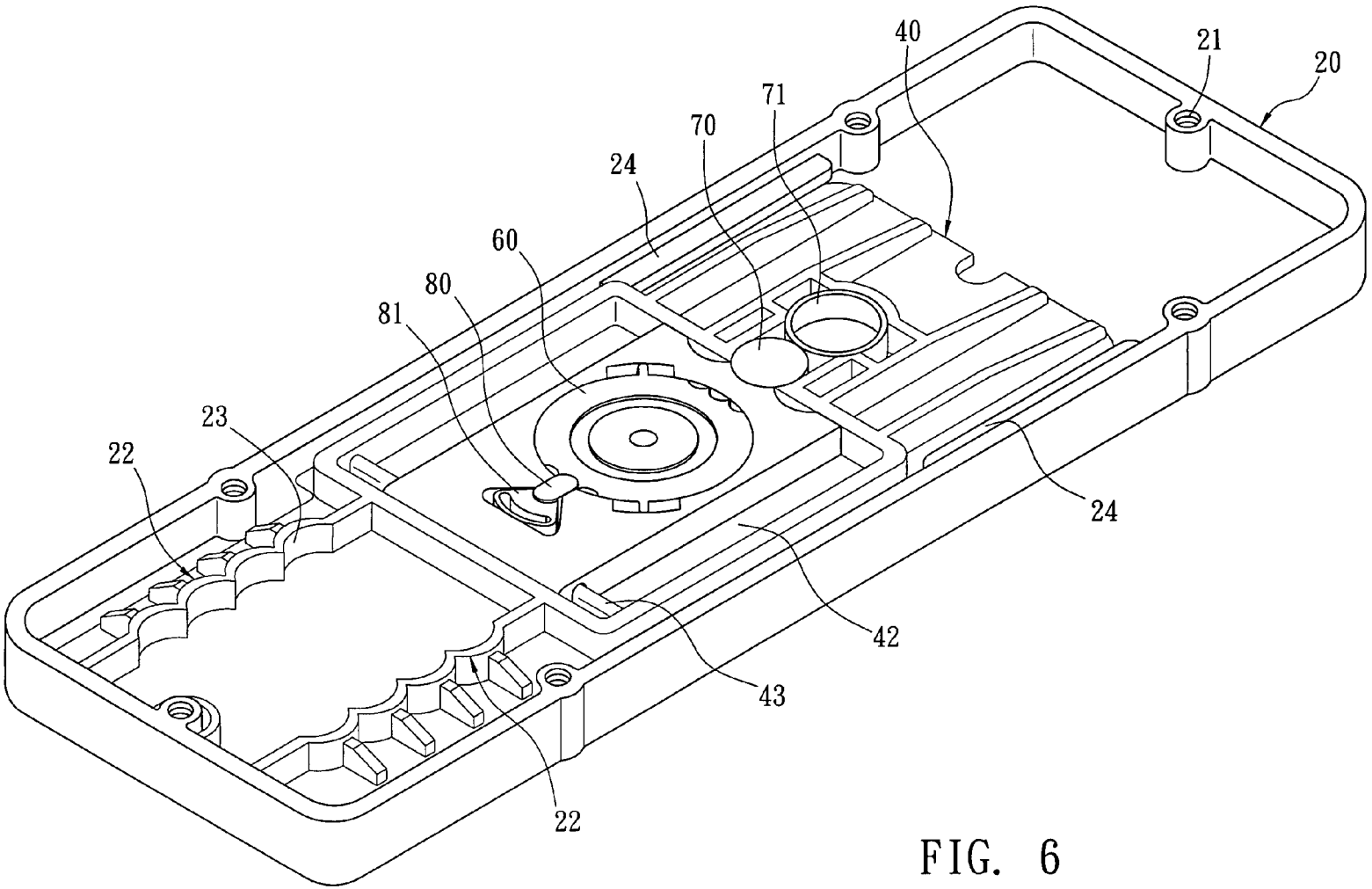
FIG. 6 is a schematic drawing of partial assembly of the embodiment in FIG. 5 according to the present invention.

Refer to FIG. 5 & FIG. 6, the difference of this embodiment and above embodiment is in that: the linear locating slots 22 originally disposed on right and left sides of inner part of the lower plate 20 is changed into corresponding positions on the removable block 40. That's the position for disposition of the slots 41, the locating ring 70 and the elastic member 71. Then the slots 41, the locating ring 70 and the elastic member 71 originally disposed on the removable block 40 are placed into corresponding positions on inner part of the hard plate layer 12. Thus when the lower plate 20 is fastened with the hard plate layer 12 of the armrest plane 10, the locating ring 70 and the elastic member 71 correspond to two linear locating slots 22. Therefore, the removable block 40 is located by the locating ring 70 being elastically assembled with one of the curved slots 23 of the locating slot 22 while sliding inside the lower plate 20 and the armrest 1 is able to be adjusted forwards and backwards.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An adjustment mechanism for armrests which disposed on top of an armrest support comprising:

an armrest plane, a lower plate, a base, a removable block, a rectangular piece, a disc, a locating ring as well as a corresponding elastic member, a locating pin and a corresponding elastic member, wherein the armrest plane is fastened with the lower plate so as to form a rectangular space between the armrest plane and the lower plate for accommodation of adjustment members;

the lower plate having two linear locating slots, formed by a plurality of curved slots, symmetrically mounted on right and left sides on one end of an inner part thereof;

the removable block is mounted inside the lower plate and with length shorter than the length of the inner part of the lower plate; two symmetrical slots are arranged on right and left sides of one end of the removable block for accommodation of a locating ring as well as an elastic member that presses the locating ring; the slots correspond to the locating slots of the lower plate so that the removable block slides forward and backward inside the lower plate and the removable block is located by the locating ring elastically mounting into one of the curved slots of the locating slots; a rectangular slot is set near a middle part of the removable block while a transverse slot is disposed near the middle part inside the rectangular slot and a slot is set on one side of the rectangular slot for accommodating a locating ring as well as an elastic member that presses the locating ring so that the locating ring presses elastically toward an inner part of the rectangular slot;

the rectangular piece whose width is smaller than the width of an inner part of the rectangular slot is mounted inside the rectangular slot of the removable block; a plurality of curved slots, corresponding to the slot of the removable block, is arranged linearly on one side of the rectangular piece so that the rectangular piece is located inside the rectangular slot by the locating ring inside the slot elastically matching one of the curved slots while sliding transversely therein; a round slot with a central hole on the bottom thereof is disposed near a middle part of the rectangular piece; a slot is disposed on circumference of the round slot for accommodating a locating pin and an elastic member that presses the locating pin so that the locating pin elastically presses an inner part of the round slot;

the disc is assembled inside the round slot of the rectangular piece; a step-like collar is formed on bottom of the disc, corresponding to and assembling with the central hole on bottom of the round slot; a rectangular hole is arranged on a bottom of the collar, corresponding to and secured with a fastening seat on the base; a plurality of locating slots corresponding to the slot of the rectangular piece is disposed on circumference of the disc so that while rotating inside the round slot, the disc is located by the locating pin inside the slot elastically matching with the locating slot; by a fastening member inserting through a central hole on the disc, the rectangular piece, and the transverse slot on bottom of the removable block, the disc is secured on a fastening hole of the fastening seat of the base;

the base attaches on the bottom of the lower plate and having a fastening seat and a fastening hole on the fastening seat for securing the disc with the base while a lock hole is respectively arranged on two sides of the base for fastening the base with the armrest support;

thereby, the armrest plane is fastened with the lower plate to form an armrest while the disc, the base and the armrest support are integrated with one another;

wherein the lower plate slides forwards and backwards, relative to the removable block, the removable block is able to move transversely, relative to the rectangular piece and the rectangular piece rotates in a certain angle relative to the disc so that rotation angle, longitudinal displacement and transverse displacement of the armrest is adjustable.

2. The adjustment mechanism for armrests as claimed in claim 1, wherein a strip-type flange is disposed on both right and left sides of the lower plate symmetrically and a sliding slot is formed under the flange so that transverse edges of the removable block slide inside the sliding slot under the flange.

3. The adjustment mechanism for armrests as claimed in claim 1, wherein a transverse guiding rail is arranged on one side of an inner part of the rectangular slot while a corresponding transverse slot is disposed on bottom of the rectangular piece so that the transverse slot assembles with the transverse guiding rail inside the rectangular slot.

4. The adjustment mechanism for armrests as claimed in claim 1, wherein the elastic member is a rubber ring with elasticity.

5. The adjustment mechanism for armrests as claimed in claim 1, wherein the locating slots on a circumference of the disc are arranged in a certain central angle.

6. The adjustment mechanism for armrests as claimed in claim 1, wherein the locating slots on a circumference of the disc are disposed on a whole circumference of the disc.

* * * * *